US009435192B2

(12) United States Patent
Lawrence et al.

(10) Patent No.: US 9,435,192 B2
(45) Date of Patent: Sep. 6, 2016

(54) DOWNHOLE ELECTROCHEMICAL SENSOR AND METHOD OF USING SAME

(71) Applicant: Schlumberger Technology Corporation, Sugar Land, TX (US)

(72) Inventors: Nathan S. Lawrence, Cambridgeshire (GB); Andrew Meredith, Cambridge (GB); Kay McGuinness, Cambridgeshire (GB); Markus Pagels, Calgary (CA); Timothy G. J. Jones, Cambs (GB); Andrew Howe, Cambridge (GB); Richard Ferguson, Shibuya-ku (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 145 days.

(21) Appl. No.: 14/072,795

(22) Filed: Nov. 6, 2013

(65) Prior Publication Data

US 2015/0122487 A1 May 7, 2015

(51) Int. Cl.

| | |
|---|---|
| ***E21B 47/06*** | (2012.01) |
| ***E21B 47/00*** | (2012.01) |
| ***E21B 49/08*** | (2006.01) |

(52) U.S. Cl.

CPC ..... *E21B 47/06* (2013.01); *E21B 47/00* (2013.01); *E21B 49/08* (2013.01); *E21B 2049/085* (2013.01)

(58) Field of Classification Search

CPC ..... E21B 47/00; E21B 47/06; E21B 49/08; B01J 19/00

USPC ..... 166/250.01, 252.1, 252.2, 252.3, 252.4, 166/252.5

See application file for complete search history.

(56) References Cited

U.S. PATENT DOCUMENTS

| | | | |
|---|---|---|---|
| 4,226,693 | A | 10/1980 | Maes |
| 4,483,397 | A | 11/1984 | Gray |
| 4,501,323 | A | 2/1985 | Lively et al. |

(Continued)

FOREIGN PATENT DOCUMENTS

| | | |
|---|---|---|
| GB | 2476237 | 6/2011 |
| WO | 2007/098221 | 8/2007 |

OTHER PUBLICATIONS

International search report and written opinion for the equivalent PCT patent application No. PCT/US2014/064395 issued on Feb. 16, 2015.

(Continued)

*Primary Examiner* — Doug Hutton, Jr.
*Assistant Examiner* — Silvana Runyan
(74) *Attorney, Agent, or Firm* — Jody Lynn DeStefanis; Daryl R. Wright

(57) ABSTRACT

An electrochemical sensor of a downhole tool positionable in a wellbore penetrating a subterranean formation is provided. The downhole tool has a flowline to receive downhole fluid. The electrochemical sensor includes a bulkhead carried by the downhole tool, a membrane exposed to the downhole fluid in the flowline, and an electrochemical cell supported by the bulkhead about the membrane. The electrochemical cell includes a plurality of cell sensors, at least one cell electrode, and a sensing solution. The plurality cell sensors include an analyte sensor, a temperature sensor, and a pH sensor. The sensing solution is reactive to certain analytes in the downhole fluid to generate electrical signals measurable by the plurality of cell sensors whereby parameters of chemicals in the downhole fluid may be measured.

14 Claims, 8 Drawing Sheets

(56) References Cited

U.S. PATENT DOCUMENTS

| | | | | |
|---|---|---|---|---|
| 4,501,989 | A | 2/1985 | von der Brake | |
| 4,605,065 | A | 8/1986 | Abercrombie | |
| 4,688,638 | A | 8/1987 | Williams | |
| 5,627,749 | A | 5/1997 | Waterman et al. | |
| 6,040,406 | A | 3/2000 | Carrier et al. | |
| 6,176,323 | B1 | 1/2001 | Weirich et al. | |
| 6,223,822 | B1 | 5/2001 | Jones | |
| 6,939,717 | B2 | 9/2005 | Jiang et al. | |
| 7,025,138 | B2 | 4/2006 | Kurkjian et al. | |
| 7,222,671 | B2 | 5/2007 | Caudwell et al. | |
| 7,458,252 | B2 | 12/2008 | Freemark et al. | |
| 7,516,654 | B2 | 4/2009 | DiFoggio | |
| 7,520,160 | B1 | 4/2009 | Toribio et al. | |
| 8,177,958 | B2 | 5/2012 | Lawrence et al. | |
| 2004/0005715 | A1* | 1/2004 | Schabron et al. | 436/104 |
| 2004/0045350 | A1 | 3/2004 | Jones et al. | |
| 2009/0014325 | A1 | 1/2009 | Jones et al. | |
| 2009/0090176 | A1 | 4/2009 | Toribio et al. | |
| 2010/0147065 | A1* | 6/2010 | Tan et al. | 73/152.24 |
| 2011/0048969 | A1 | 3/2011 | Lawrence et al. | |

OTHER PUBLICATIONS

N.S. Lawrence, J. Davis, R.G. Compton, "Analytical strategies for the detection of sulfide: a review", Talanta, 52 (2000) pp. 771-784.

M. Garcia-Calzada, G. Marban, A.B. Fuertes, "Potentiometric determination of sulphur in solid samples with a sulphide selective electrode", Analitica Chimica Acta, 380 (1999) pp. 39-45.

Thermo Electron Corporation "Olion Silver/Sulfide Electrode, Instruction Manual", Orion 94-16, Orion 94-16 ionplus.

V. Stanic, T.H. Etsell, A.C. Pierre, R.J. Mikula, "Determination of sulfur compounds in the sol-gel processing of GeS2 by potentiometric titration" Electrochim. Acta, vol. 43 , No. 18, 1998, pp. 2639-2647.

P. Jeroschewski, K. Haase, A. Trommer, P. Gründler, "Galvanic sensor for the determination of hydrogen sulphide/sulphide in aqueous media", Fresenius' Journal of Analytical Chemistry (1993), 346, pp. 930-933.

Jeroschewski, K. Haase, A. Trommer, P. Gründler, "Galvanic Sensor for Determination of Hydrogen Sulfide", Electroanalysis, 6 (1994) pp. 769-772.

P. Jeroschewski, S. Braun, "A flow analysis system with an amperometric detector for the determination of hydrogen sulphide in waters", Fresenius' Journal of Analytical Chemistry (1996), 354, pp. 169-172.

P. Jeroschewski, C. Steuckart, M. Kuhl, "An Amperometric Microsensor for the Determination of H2S in Aquatic Environments" Analytical Chemistry, vol. 68, No. 24, Dec. 15, 1996, pp. 4351-4357.

M. Kuhl, C. Steuckart, G. Eickert, P. Jeroschewski, "A H2S microsensor for profiling biofilms and sediments: application in an acidic lake sediment" Aquatic Microboal Ecology, vol. 15, pp. 201-209, 1998.

G. Schiavon, G. Zotti, R. Toniolo, G. Bontempelli, Electrochemical Detection of Trace Hydrogen Sulphide in Gaseous Samples by Porous Silver Electrodes Supported on Ion-Exchange Membranes (Solid Polymer Electrolytes), Analytical Chemistry, vol. 67, No. 2, Jan. 15, 1995, pp. 318-323.

N. Batina, I. Ciglenecki, B. Cosovic, "Determination of elemental sulphur, sulphide and their mixtures in electrolyte solutions by a.c. voltammetry", Analytica Chimica Acta, vol. 267, Issue 1, Sep. 11, 1992, pp. 157-164.

N. S. Lawrence, J. Davis, L. Jiang, T.G.J. Jones, S.N. Davies, R.G. Compton, "The Electrochemical Analog of the Methylene Blue Reaction: A Novel Amperometric Approach to the Detection of Hydrogen Sulfide", Electroanalysis 2000, 12, No. 18, pp. 1453-1460.

N. S. Lawrence, L. Jiang, T.G.J. Jones, R.G. Compton, "A Thin-Layer Amperometric Sensor for Hydrogen Sulfide: The Use of Microelectrodes to Achieve a Membrane-Independent Response for Clark-Type Sensors", Analytical Chemistry, vol. 75, No. 10, May 15, 2003, pp. 2499-2503.

N.S. Lawrence, L. Jiang, T.G.J. Jones, R.G. Compton, "Voltammetric Characterization of a N, N'-Diphenyl-p-phenylenediamine-Loaded Screen-Printed Electrode: A Disposable Sensor for Hydrogen Sulfide", Analytical Chemistry, vol. 75, No. 9, May 1, 2003, pp. 2054-2059.

N.S. Lawrence, M. Thompson, C. Prado, L. Jiang, T.G.J. Jones, R.G. Compton, "Amperometric Detection of Sulfide at a Boron Doped Diamond Electrode: The Electrocatalytic Reaction of Sulfide with Ferricyanide in Aqueous Solution." Electroanalysis 2002, 14, No. 7-8, pp. 499-504.

Nathan S. Lawrence, Gary J. Tustin, Michael Faulkner, Timothy G.J. Jones, "Ferrocene sulfonates as electrocatalysts for sulfide detection", Electrochimica Acta, vol. 52, Issue 2, Oct. 25, 2006, pp. 499-503.

Kjersti Håland, Texas A&M University; Statoil; Maria A. Barrufet, Texas A&M University; Hans P. Rønningsen, Knut K. Meisingset, Statoil, "An Empirical Correlation Between Reservoir Temperature and the Concentration of Hydrogen Sulfide", SPE International Symposium on Oilfield Chemistry, Feb. 16-19, 1999, Houston, Texas.

A. P. F. Turner, I. Karube, G. S. Wilson (Eds.), Biosensors. Fundamentals and Applications, Oxford University Press, Oxford, 1987.

F.G.K. Baucke, "The glass electrode—applied electrochemistry of glass surfaces", Journal of Non-Crystalline Solids, vol. 73, Issues 1-3, Aug. 1985, pp. 215-231.

G. Palleshi, G. Volpe, D. Compagnone, E. La. Notte, M. Esti, "Biochemical Determination of Lactic and Malic Acids in Wine", Talanta, vol. 41, No. 6, 1994, pp. 917-923.

C. N. Aquino, N. Kumar, L. N. Lamb, P. J. Pigram, "Fabrication and Characterization of a Hydroquinone-Functionalized Polypyrrole Thin-Film pH Sensor", Chem. Mater., 1996, 8, pp. 2579-2585, published by American Chemical Sosiety.

S. Komba, M. Seyma, T. Momma, T. Osaka, "Potentiometric biosensor for urea based on electropolymerized electroinactive polypyrrole" Electrochimica Acta, vol. 42, No. 3, pp. 383-388, 1997.

J. Janata, "Potentiometric Microsensors", Chemical Reviews, 1990, vol. 90, No. 5, pp. 691-703, published by American Chemical Society.

J. J. Hickman, D. Ofer, P. E. Laibinis, G. M. Whitesides, M. S. Wrighton, "Molecular self-assembly of two-terminal, voltammetric microsensors with internal references", Science, May 3, 1991, 252, pp. 688-691.

O. Ben-David, E. Shafir, I. Gilath, Y. Prior, D. Avnir, "Simple Absorption Optical Fiber pH Sensor Based on Doped Sol-Gel Caldding Material", Chem. Mater., 1997, 9, pp. 2255-2257.

M.Pandurangappa, N. S. Lawrence, R. G. Compton, 'Homogeneous chemical derivatisation of carbon particles : a novel method for functioning carbon surfaces', Analyst, 2002, 127, pp. 1568-1571.

G. G. Wildgoose, M. Pandurangappa, N. S. Lawrence, L. Jiang, T. G. J. Jones, R. G. Compton, 'Anthraquinone-derivatised carbon powder : reagentless voltammetric pH electrodes', Talanta, 60 (2003) pp. 887-893.

M. Pandurangappa, N. S. Lawrence, L. Jiang, T. G. J. Jones, R. G. Compton, 'Physical absorption of N, N'-diphenylpphenylenediamine onto carbon particles : Application to the detection of sulfide', Analyst, 2003, 128, pp. 473-479.

I. Streeter, H. C. Leventis, G. G. Wildgoose, M. Pandurangappa, N. S. Lawrence, L. Jiang, T. G. J. Jones, R. G. Compton, 'A sensitive reagentless pH probe with a ca. 120 mV/pH unit response' , J Solid State Electrochem. (2004), 8, pp. 718-721.

H. C. Leventis, I. Streeter, G. G. Wildgoose, N. S. Lawrence, L. Jiang, T. G. J. Jones, R. G. Compton, 'Derivatised carbon powder electrodes : reagentless pH sensors' Talanta, 63 (2004), pp. 1039-1051.

G. G. Wildgoose, H. C. Leventis, I. Streeter, N. S. Lawrence, S. J. Wilkins, L. Jiang, T. G. J. Jones, R. G. Compton, "Abrasively Immobilised Multiwalled Carbon Nanotube Agglomerates: A Novel Electrode Material Approach for the Analytical Sensing of pH" ChemPhysChem, 2004, 5, pp. 669-677.

N. S. Lawrence, M. Pagels, S. F. J. Hackett , S. McCormack, A. Meredith, T. G. J. Jones, G. G. Wildgoose, R. G. Compton, L. Jiang, "Triple Component Carbon Epoxy pH Probe" Electroanalysis, 19, 2007, No. 4, 424-428.

* cited by examiner

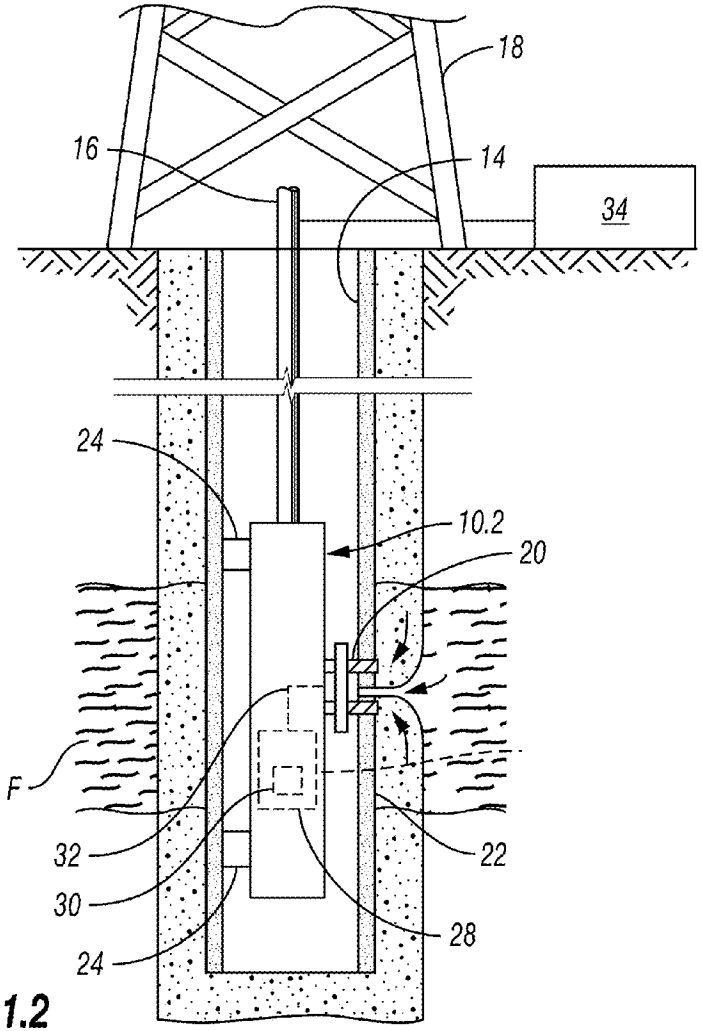
FIG. 1.2
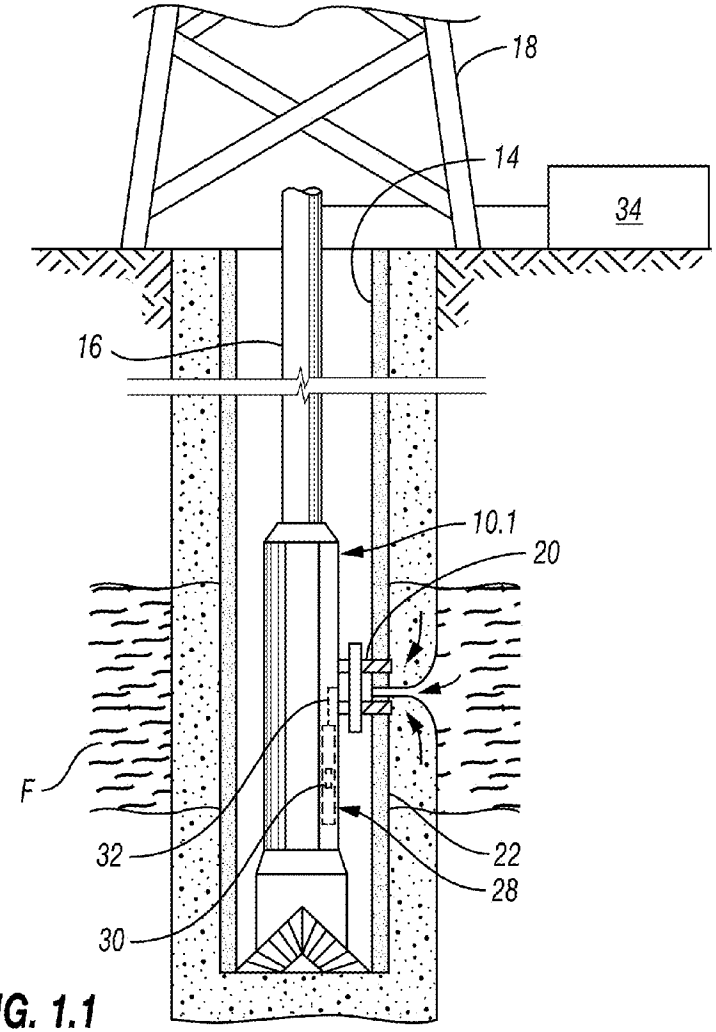
FIG. 1.1

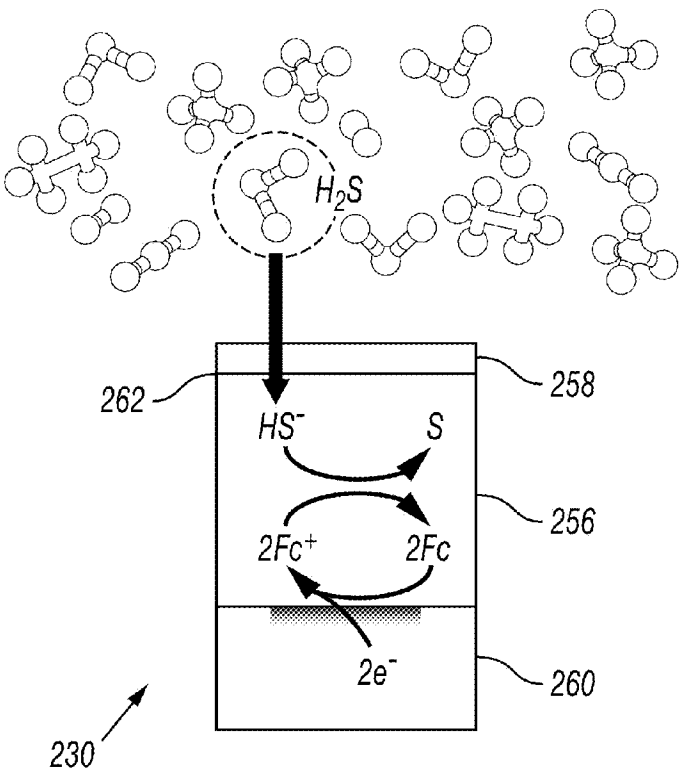
FIG. 2.2
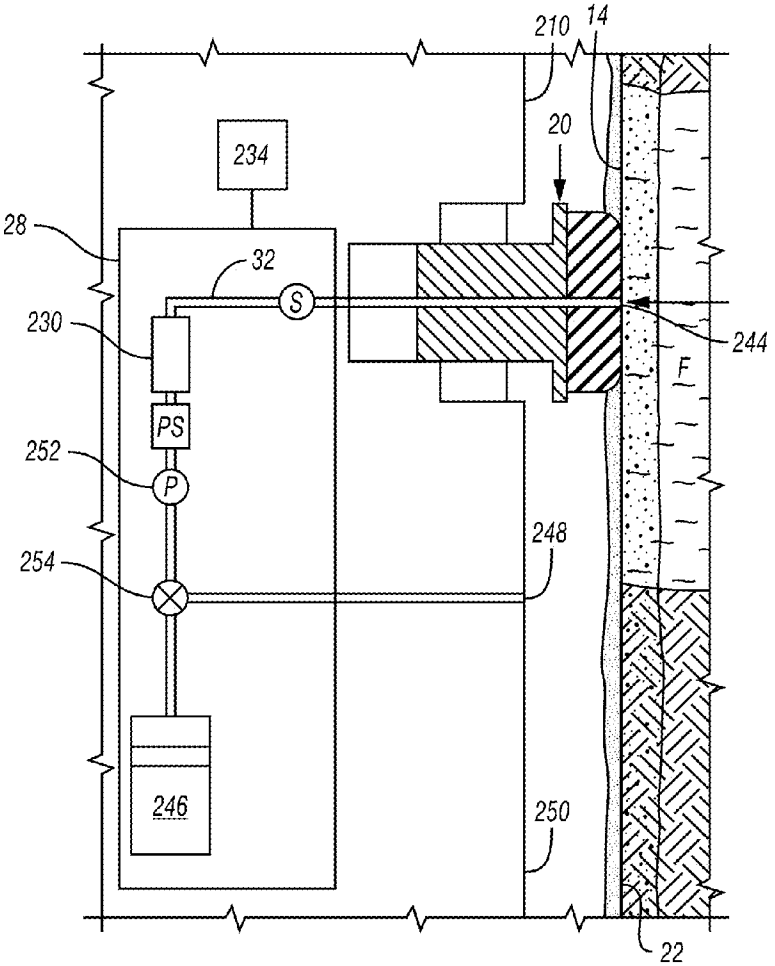
FIG. 2.1

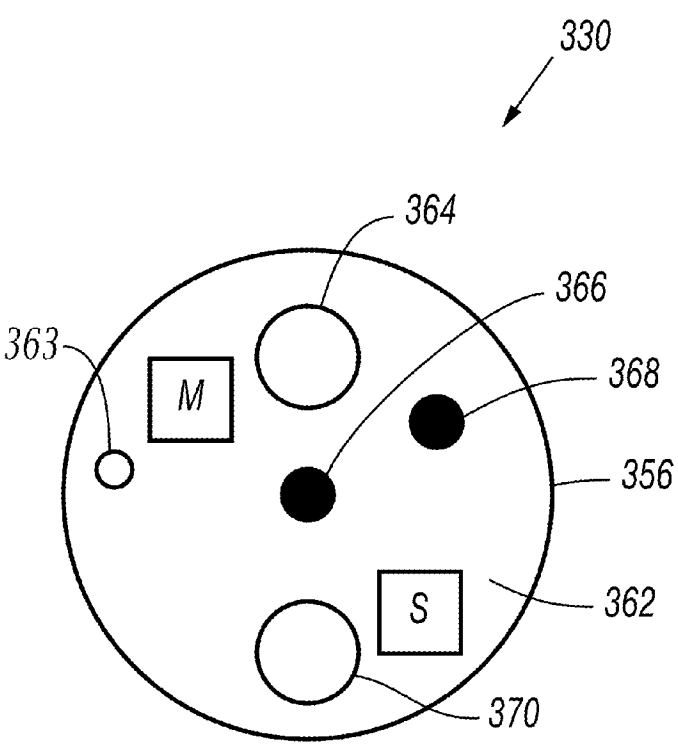
FIG. 3.2
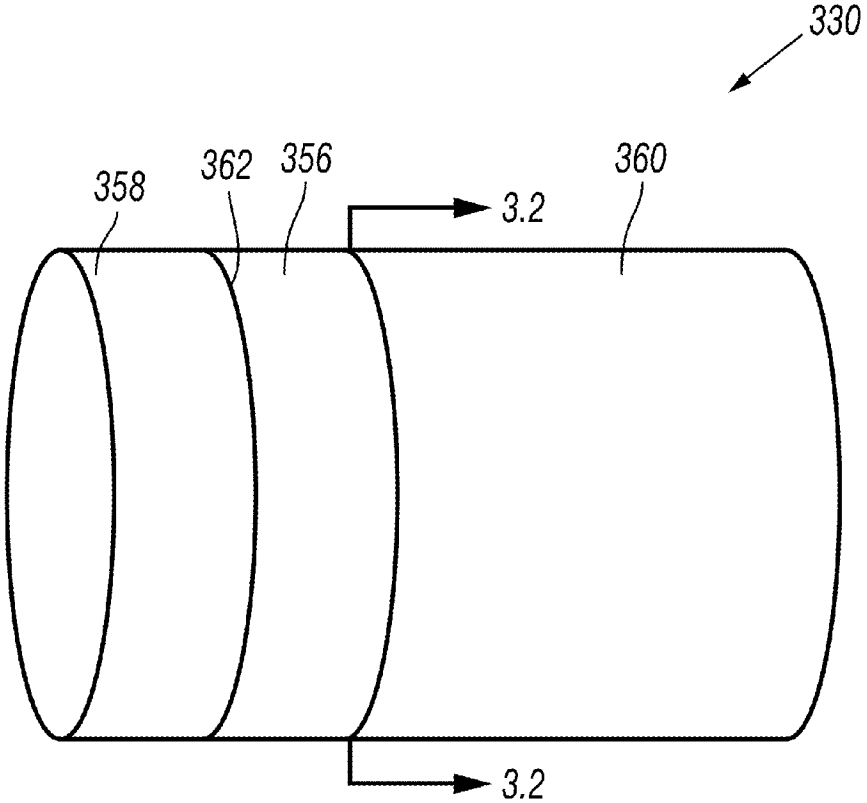
FIG. 3.1

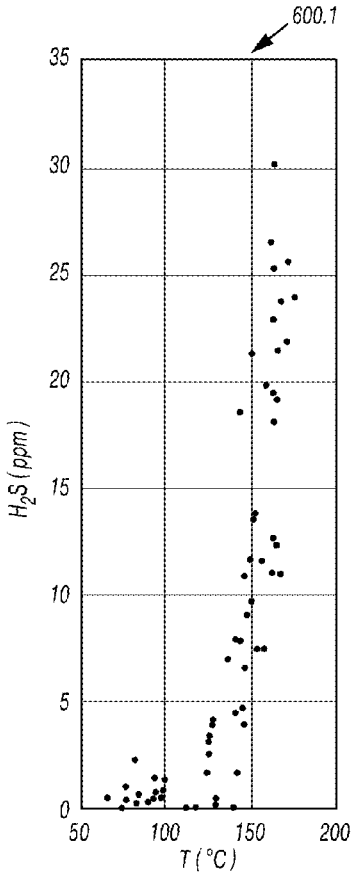
FIG. 6.1
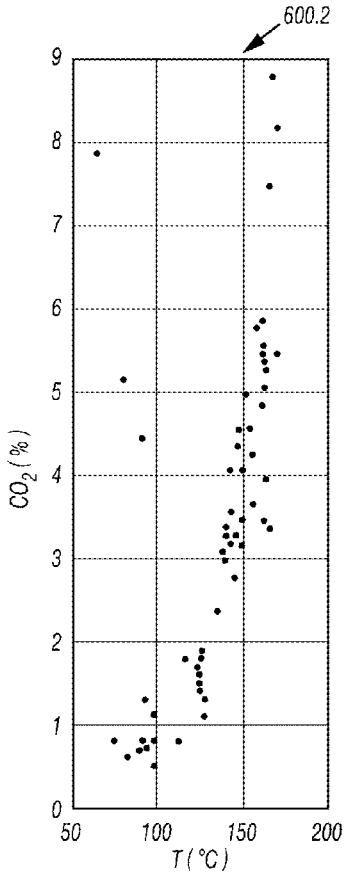
FIG. 6.2
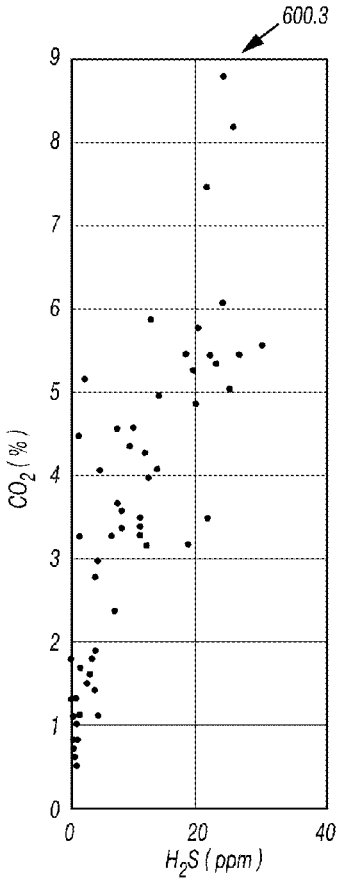
FIG. 6.3
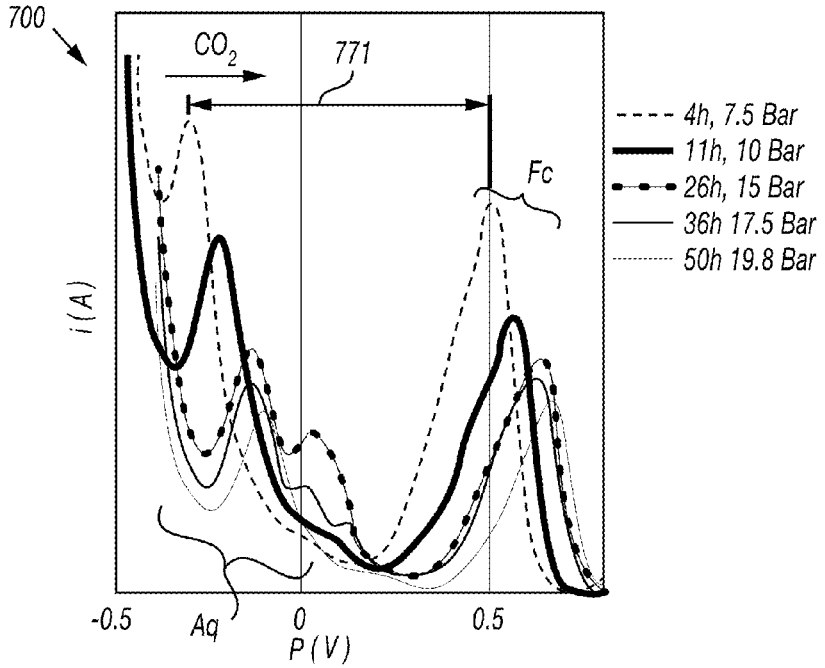
FIG. 7

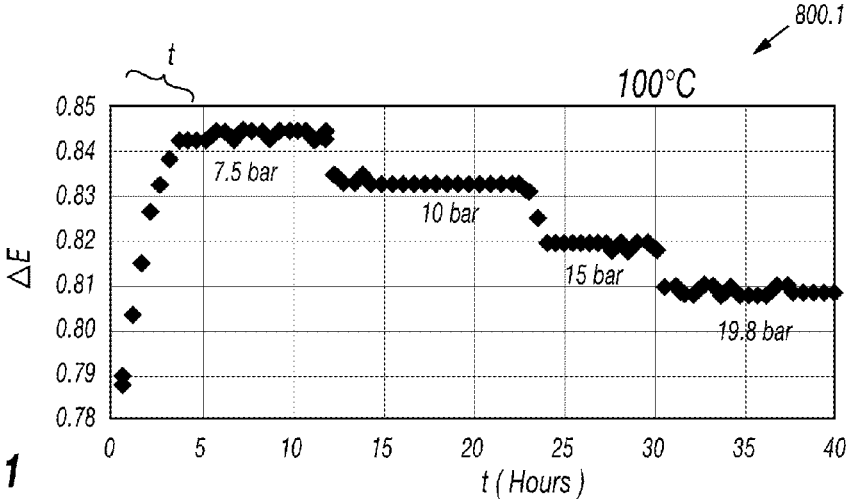
FIG. 8.1
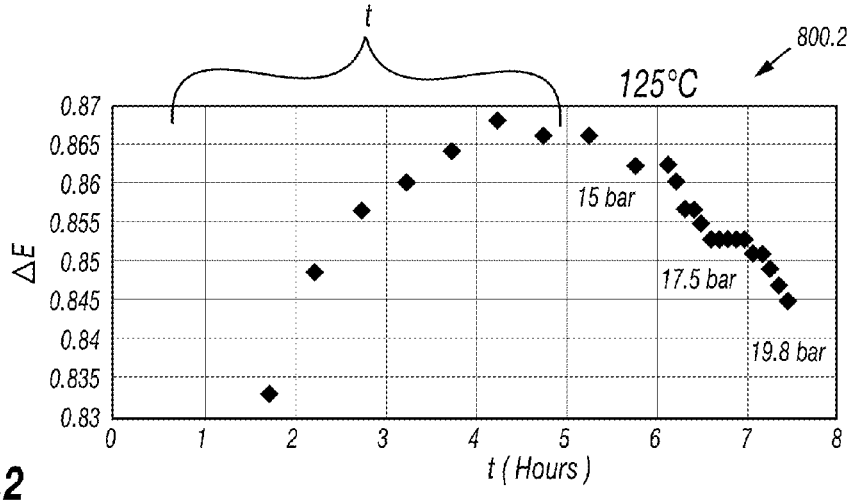
FIG. 8.2
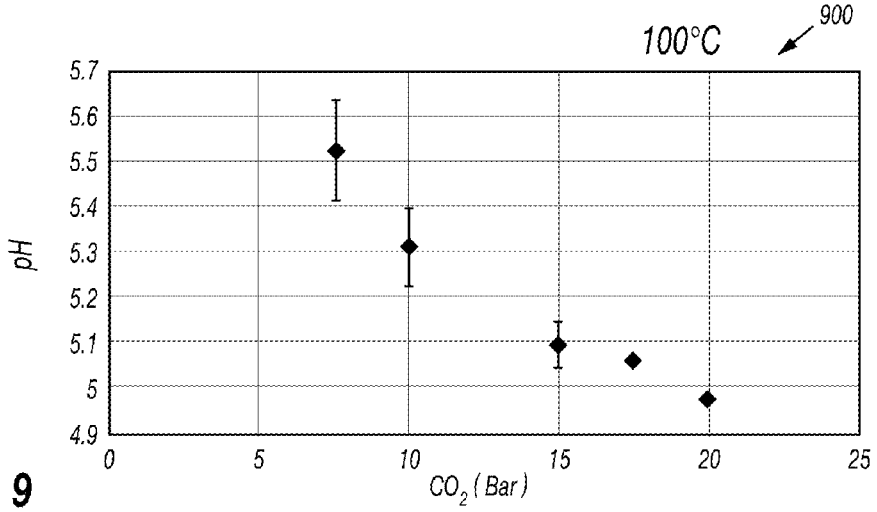
FIG. 9

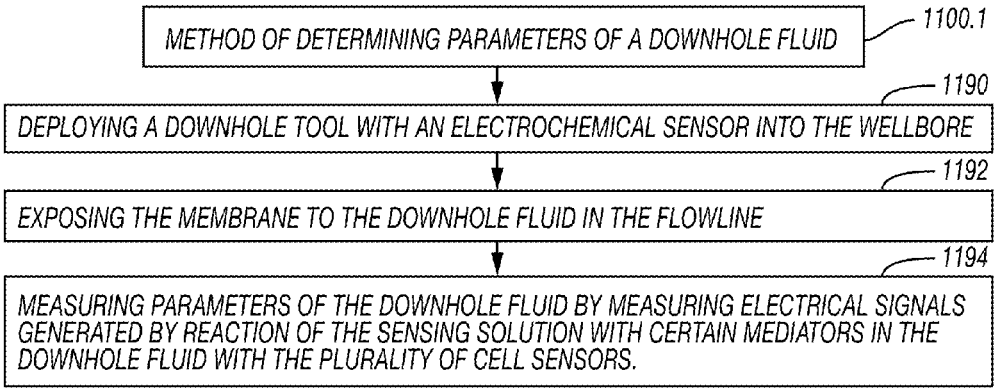
FIG. 11.1
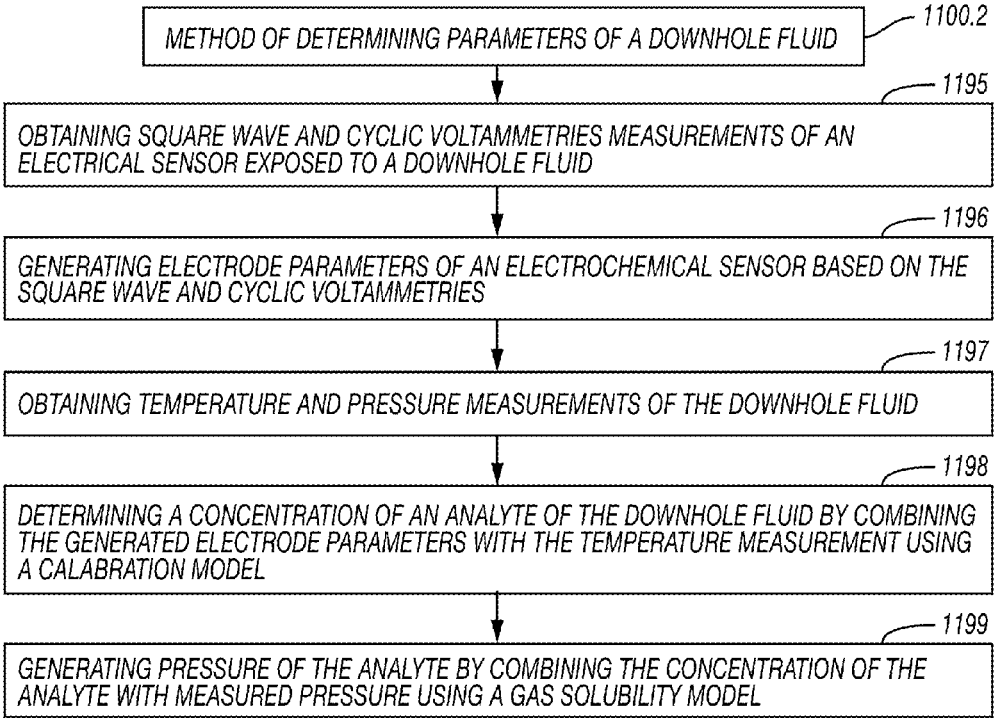
FIG. 11.2

DOWNHOLE ELECTROCHEMICAL SENSOR AND METHOD OF USING SAME

BACKGROUND

The present disclosure relates generally to wellsite operations. In particular, the present disclosure relates to downhole sensors for measuring parameters of a downhole fluid.

Wellbores are drilled to locate and produce hydrocarbons. A downhole drilling tool with a bit at an end thereof is advanced into the ground to form a wellbore. As the drilling tool is advanced, drilling mud is pumped through the drilling tool and out the drill bit to cool the drilling tool and carry away cuttings. The fluid exits the drill bit and flows back up to the surface for recirculation through the drilling tool. The drilling mud is also used to form a mudcake to line the wellbore.

During a drilling operation, various downhole evaluations may be performed to determine characteristics of the wellbore and surrounding formations. In some cases, the drilling tool may be provided with devices to test and/or sample the surrounding formation and/or fluid contained in reservoirs therein. In some cases, the drilling tool may be removed and a downhole wireline tool may be deployed into the wellbore to test and/or sample the formation. These samples or tests may be used, for example, to determine whether valuable hydrocarbons are present.

Formation evaluation may involve drawing fluid from the formation into the downhole tool for testing and/or sampling. Various devices, such as probes or packers, may be extended from the downhole tool to establish fluid communication with the formation surrounding the wellbore and to draw fluid into the downhole tool. Downhole tools may be provided with fluid analyzers and/or sensors to measure downhole parameters, such as fluid properties. Examples of downhole devices are provided in US Patent/Publication Nos. 2009/0014325, 2009/0090176, U.S. Pat. No. 6,223,822, U.S. Pat. No. 6,939,717, U.S. Pat. No. 7,222,671, U.S. Pat. No. 7,520,160, U.S. Pat. No. 7,025,138, U.S. Pat. No. 7,458,252, and U.S. Pat. No. 8,177,958, the entire contents of which are hereby incorporated by reference herein.

SUMMARY

In at least on aspect, the present disclosure relates to an electrochemical sensor of a downhole tool positionable in a wellbore penetrating a subterranean formation. The downhole tool has a flowline to receive downhole fluid. The electrochemical sensor includes a bulkhead carried by the downhole tool, a membrane exposed to the downhole fluid in the flowline, and an electrochemical cell supported by the bulkhead adjacent the membrane. The electrochemical cell includes a plurality of cell sensors, at least one cell electrode, and a sensing solution. The cell sensors include an analyte sensor, a temperature sensor, and a pH sensor. The sensing solution is reactive to certain analytes in the downhole fluid to generate electrical signals measurable by the cell sensors whereby parameters of chemicals in the downhole fluid may be measured.

In another aspect, the disclosure relates to a method of determining downhole parameters of a downhole fluid about a wellbore penetrating a subterranean formation. The downhole tool has a flowline therein to receive downhole fluid. The method involves deploying a downhole tool with an electrochemical sensor into the wellbore. The electrochemical sensor includes a bulkhead carried by the downhole tool, a membrane exposed to the downhole fluid in the flowline, and an electrochemical cell supported by the bulkhead adjacent the membrane. The electrochemical cell includes a plurality of cell sensors, at least one cell electrode, and a sensing solution. The cell sensors include an analyte sensor, a temperature sensor, and a pH sensor. The method further involves exposing the membrane to the downhole fluid in the flowline, and measuring parameters of the downhole fluid by measuring electrical signals generated by reaction of the sensing solution with certain analytes in the downhole fluid with the cell sensors.

In another aspect, the disclosure relates to a method of determining downhole parameters of a downhole fluid about a wellbore penetrating a subterranean formation. The method involves obtaining square wave and cyclic voltammetries measurements an electrochemical sensor exposed to the downhole fluid, generating electrode parameters of the electrochemical sensor based on the square wave and cyclic voltammetries (the electrode parameters including mediator concentration, current-volt relations, and pH). The method further involves obtaining temperature and pressure measurements of the downhole fluid, generating a concentration of an analyte of the downhole fluid by combining the generated electrode parameters with the temperature measurement of the downhole fluid using a calibration model, and generating pressure of the analyte by combining the concentration of the analyte with the pressure measurement of the downhole fluid using a gas solubility model.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the downhole electrochemical measurement method are described with reference to the following figures. The same numbers are used throughout the figures to reference like features and components.

FIGS. 1.1 and 1.2 depict schematic views, partially in cross-section, of a wellsite with a downhole drilling tool and a downhole wireline tool, respectively, deployed into a wellbore and having an electrochemical sensor in accordance with embodiments of the present disclosure;

FIGS. 2.1 and 2.2 are schematic views illustrating a portions of a downhole tool and an electromechanical sensor reactive to downhole chemicals in accordance with embodiments of the present disclosure;

FIGS. 3.1 and 3.2 are perspective and end schematic views of an electrochemical sensor in accordance with embodiments of the present disclosure;

FIGS. 6.1-6.3 are graphs illustrating a relationship between H2S and CO2 concentrations in accordance with embodiments of the present disclosure;

FIG. 7 is a graph illustrating voltammograms of an electromagnetic sensor at various CO2 concentrations in accordance with embodiments of the present disclosure;

FIGS. 8.1 and 8.2 are graphs illustrating changes in pH measurements of an electrochemical sensor over time in accordance with embodiments of the present disclosure;

FIG. 9 is a graph illustrating pH measurements of an electromechanical sensor at various CO2 pressures in accordance with embodiments of the present disclosure;

FIGS. 11.1 and 11.2 are flow charts illustrating methods of determining parameters of a downhole fluid.

DETAILED DESCRIPTION

Figure 4:
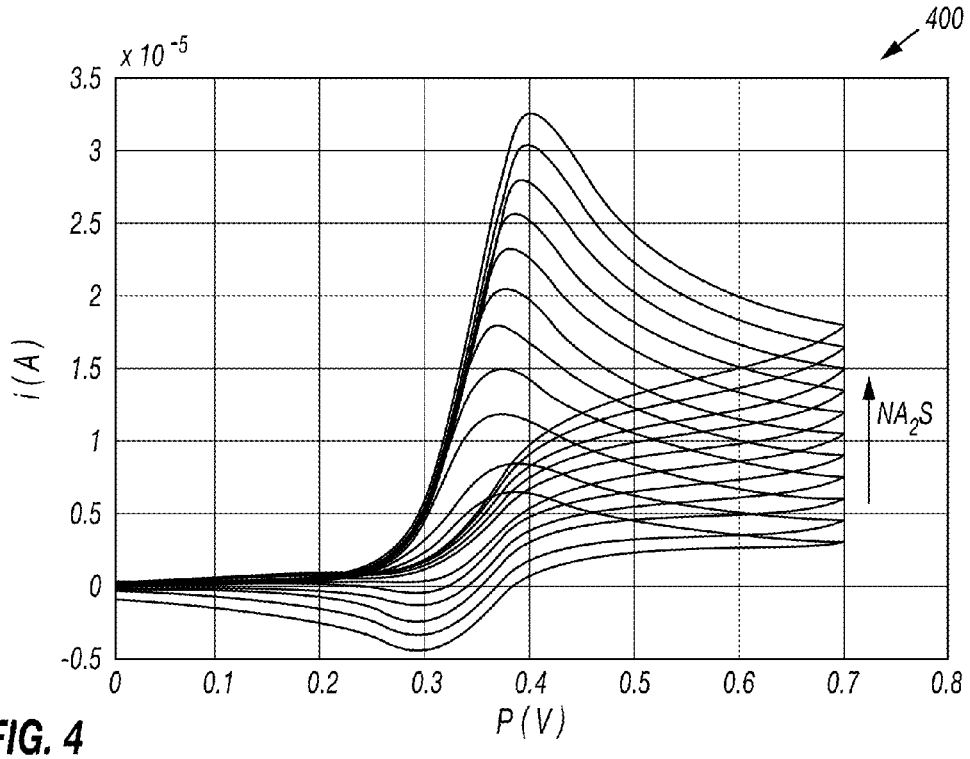
FIG. 4 is a graph illustrating voltammetric output of an electrochemical sensor in accordance with embodiments of the present disclosure.

The description that follows includes exemplary apparatuses, methods, techniques, and instruction sequences that embody techniques of the inventive subject matter. However, it is understood that the described embodiments may be practiced without these specific details.

The present disclosure relates to formation evaluation involving measurements of downhole fluid. Measurements of fluid parameters may be taken using an electrochemical sensor deployed into a wellbore on a downhole tool. The electrochemical sensor may include a protective membrane with a combination of cell sensors and cell electrodes to measure various fluid parameters. The electrochemical sensor may be used to take various measurements to determine phase behavior and chemical composition, and/or to detect gases, such as hydrogen sulfide (H2S), carbon dioxide (CO2), and methane (CH4). Outputs from the electrochemical sensor may be combined using a measurement chain to determine various downhole parameters, such as pressure and/or concentration of H2S in downhole fluids.

Downhole fluids may be measured and/or analyzed to determine phase behavior and chemical composition. Chemical composition of downhole fluids and/or concentrations of gaseous components, such as H2S, CO2 and CH4, may be used to evaluate producibility and/or economic value of hydrocarbon reserves. Certain chemicals, such as H2S and CO2, may affect downhole operations. For example, the presence of certain chemicals, such as CO2 and H2S, may lead to failures due to, for example, corrosion, stress cracking, welding, pitting, erosion, galvanic, and stress deterioration. H2S may be detected in fluids found in the permeable formations of oil wells. Sulfur content of crude oils may be in the range of from about 0.30 to about 0.80 weight percent. The content of H2S in natural gas may be in the range of from about 0.01 to about 0.40 weight percent, and concentrations of H2S in natural gas of up to 30 weight percent FIGS. 1.1 and 1.2 depict environments in which subject matter of the present disclosure may be implemented. While the examples provided relate to downhole applications, the electrochemical sensor and methods may be used in any environment. FIG. 1.1 depicts a downhole drilling tool 10.1 and FIG. 1.2 depicts a downhole wireline tool 10.2 that may be used for performing formation evaluation. The downhole drilling tool 10.1 may be advanced into a subterranean formation F to form a wellbore 14. The downhole drilling tool 10.1 may be conveyed alone or among one or more (or itself may be) measurement-while-drilling (MWD) drilling tools, a logging-while-drilling (LWD) drilling tools, or other drilling tools. The downhole tool 10.1 is attached to a conveyor (e.g., drillstring) 16 driven by a rig 18 to form the wellbore 14. The downhole tool 10.1 includes a probe 20 adapted to seal with a wall 22 of the wellbore 14 to draw fluid from the formation F into the downhole tool 10.1 as depicted by the arrows.

The downhole drilling tool 10.1 may be withdrawn from the wellbore 14, and the downhole wireline tool 10.2 of FIG. 1.2 may be deployed from the rig 18 into the wellbore 14 via conveyance (e.g., a wireline cable) 16. The downhole wireline tool 10.2 is provided with the probe 20 adapted to seal with the wellbore wall 22 and draw fluid from the formation F into the downhole tool 10.2. Backup pistons 24 may be used to assist in pushing the downhole tool 10.2 and probe 20 against the wellbore wall 22 and adjacent the formation F.

The downhole tools 10.1, 10.2 may also be provided with a formation evaluation tool 28 with an electrochemical sensor 30 for measuring downhole parameters. The formation evaluation tool 28 includes a flowline 32 for receiving the formation fluid from the probe 20 and passing the fluid to the electrochemical sensor 30 for measurement as will be described more fully herein. A surface unit 34 may be provided to communicate with the downhole tool 10.1, 10.2 for passage of signals (e.g., data, power, command, etc.) therebetween.

While FIGS. 1.1 and 1.2 depict specific types of downhole tools 10.1 and 10.2, any downhole tool capable of performing formation evaluation may be used, such as drilling, coiled tubing, wireline or other downhole tool. Also, while FIGS. 1.1 and 1.2 depict the formation evaluation tool 28 in a wellbore 14, it will be appreciated that the formation evaluation tool 28 and/or the electrochemical sensor 30 may be used at a surface and/or downhole location at the wellsite, and/or at an offsite facility for measuring fluid parameters.

FIGS. 2.1 and 2.2 depict a portion of the downhole tool 210, which may be either of the downhole tools 10.1 or 10.2 of FIG. 1.1 or 1.2. FIG. 2.1 shows the portion of the downhole tool 210 positioned against a wall 22 of the wellbore 14 for drawing fluid therein for measurement by an electrochemical sensor (or transducer) 230. FIG. 2.2 shows a detailed view of the electrochemical sensor 230 reacting to an analyte (e.g., H2S) in the fluid.

The downhole tool 210 includes the probe 20, formation evaluation tool 28, and the electrochemical sensor 230. The downhole tool 210 may be provided with one or more flowlines 32 for drawing fluid into the downhole tool 210 through an inlet 244 in the probe 20. While one probe 20 is depicted, one or more probes, dual packers and related inlets may be provided to receive downhole fluids and pass them to one or more flowlines 32. Examples of downhole tools and fluid communication devices, such as probes, that may be used are depicted in U.S. Pat. No. 7,458,252, previously incorporated herein.

The flowline 32 passes fluid from the probe 20 to the formation evaluation tool 28 for measurement. The formation evaluation tool may be provided with a sample chamber 246 coupled to the flowline 32 for receiving the downhole fluid. Fluid collected in the sample chamber 246 may be collected therein for retrieval at the surface, or may be exited through an outlet 248 in housing 250 of the downhole tool 210. Optionally, flow of the downhole fluid into and/or through the downhole tool 210 may be manipulated by one or more flow control devices, such as a pump 252, the sample chamber 246, valve 254 and/or other devices.

The electrochemical sensor 230 is positioned in the formation evaluation tool 28 and is coupled to the flowline 32 for measuring parameters of downhole fluid passing through the flowline 32. The electrochemical sensor 230 may be used to detect certain chemicals in the downhole fluid. Detection may be performed using electrochemical techniques, such as sensor detection, potentiometric, galvanostatic, amperometric and other electrochemical techniques.

As shown in FIG. 2.2, the electrochemical sensor 230 may be reactive to certain chemicals in the downhole fluid, such as H2S and/or other corrosive and/or potentially detrimental materials. The electrochemical sensor 230 includes an electrochemical cell 256 positioned between a bulkhead 260 and a gas permeable membrane 258. The bulkhead 260 may be a non-magnetic material, such as polyether ether ketone (PEEK), capable of supporting the electrochemical cell and the electrodes 256 in the downhole tool 210.

The gas permeable membrane 258 is positioned about the flowline 32 for exposure to the downhole fluid therein. The membrane 258 allows transport of gaseous species, such as H2S through the membrane 258 and into the electrochemical cell 256. In the example of FIG. 2.2, the electrochemical cell 256 has sensing solution including an electrocatalytic mediator (e.g., water-soluble ferrocene) dissolved in an aqueous solution within the electrochemical cell 256. This species may oxidize at a sensing surface 262 of the electrochemical cell 256 (e.g., at the surface of the electrodes) to form ions which, when H2S is present, are reduced back to their parent state. The mediator can then be re-oxidized at the sensing surface 262. The electrochemical sensing surface 262 is configured to measure electrical changes resulting from the reactions generated by the oxidation of the ferrocene mediator.

The electrochemical sensor 230 may provide, for example, a mechanistic pathway detailing the electrocatalytic reduction of ferrocenium by sulfide. For example, ferrocene may oxidize at the sensing surface 262 of the electrochemical cell 256 to form ferricenium ions when sulfide is present, and to homogeneously reduce the ferricenium ion back to ferrocene which can be re-oxidized at the sensing surface 262. An apparent increase in ferricenium ions perturbs baseline voltammetry through an increase in oxidative current (and charge), which can be measured by the electrochemical cell 256 and used to determine the concentration of chemicals (e.g., H2S) in the downhole fluid.

Referring back to FIG. 2.1, one or more additional sensors S may optionally be provided to measure various downhole parameters and/or fluid properties. The sensor(s) S may include, for example, gauges (e.g., quartz), densitometers, viscometers, resistivity sensors, nuclear sensors, and/or other measurement and/or detection devices capable of taking downhole data relating to, for example, downhole conditions and/or fluid properties. As shown a pressure sensor PS is also provided to measure pressure of fluid in the flowline 32.

Optionally, the downhole tool may be provided with a downhole unit 234 which may be similar to the surface unit 34 (FIGS. 1.1 and 1.2). The downhole unit 234 may be in communication with the surface unit 34, the formation evaluation tool 28, the electrochemical sensor 30, and/or other portions of the downhole tool 10 for the passage of signals (e.g., data, power, command, etc.) therebetween. The surface unit 34 and/or the downhole unit 234 may be provided with processing capabilities (e.g., a central processing unit (CPU)) to selectively combine and/or analyzed the data, and/or databases to collect data from a variety of sources. The surface unit 34 and/or the downhole unit 234 may be provided with analytical capabilities, such as modeling, to process various data as needed.

FIGS. 3.1 and 3.2 depict an electrochemical sensor 330 usable with the downhole tools 10.1, 10.2, 10 of FIGS. 1.1-2.1. FIG. 3.1 shows a perspective view of the electrochemical sensor 330. FIG. 3.2 shows a cross-sectional view of the electrochemical sensor 330 taken along line 3.2-3.2. The electrochemical sensor 330 includes an electrochemical cell 356 supported on a bulkhead 360 and protected by a membrane 358. The bulkhead 360 may be the same as bulkhead 260.

The electrochemical cell 356 may include a variety of electrodes, sensor, gauges or other devices capable of measuring downhole parameters. As shown, the electrochemical cell is provided with cell electrodes including a reference electrode 363 and a counter electrode 364. The electrochemical cell 356 also includes a combination of cell sensors including an analyte sensor 366, a pH sensor 368, and a temperature probe 370. The electrodes and cell sensors have a sensing end positioned along a sensing surface 362 of the electrochemical cell 356 adjacent the membrane 358.

The reference and counter electrodes 363, 364 may be conventional electrodes capable of providing reference and counting measurements. The counter (or auxiliary) electrode 364 may be used with the reference electrode 363 and the sensing electrodes for voltammetric analysis or other reaction in which electrical current flows. The reference electrode 363 may be used to establish an electrical potential against which other potentials may be measured. The electrodes 363, 364 may be smaller than (e.g., about half the size of) the cell sensors.

The analyte sensor 366 may be any sensor capable of detecting and/or measuring parameters of chemicals, such as H2S, CH4, CO2, HG, O2, H2, and/or analytes, in the downhole fluid. The analyte sensor 366 may be, for example, a boron-doped diamond (BDD), glassy carbon, graphitic substrates, platinum and/or gold electrode. The analyte sensor 366 may be configured, for example, to measure square wave and cyclic voltammetries of various chemicals within the electrochemical sensor 330.

The pH sensor 368 may be any sensor capable of detecting pH of a chemical in the downhole fluid, such as a modified edge plane graphite (EPPG) electrode. The pH measurement may be based upon either amperometric, potentiometric, or other types of measurement. The potentiometric approach may, for example, utilize a glass electrode to facilitate handling and high selectivity towards pH sensing. A range of other pH sensors that may be used may be based upon ion-selective membranes, ion-selective field-effect transistors, terminal microsensors, as well as optical, and metal oxide layers. One or more such pH sensors may be used.

The pH sensor may be a pH probe fabricated based on, for example, the redox chemistry of anthraquinone, N,N'-diphenyl-p-phenylenediamine (DPPD), and/or nickel hexacyanoferrate. Detection protocol may rely upon, for example, pH sensitivity of the redox chemistry of anthraquinone or DPPD and the pH insensitivity of the nickel-hexacyanoferrate redox species. Such detection may be extended to other redox active pH sensitive and pH insensitive compounds.

In an example, the pH sensor 368 uses an anthraquinone modified edge plane pyrolytic graphite electrode, and the water soluble mediator t-butylferrocene sulfonate used to detect sulfide. In this case the pH sensor 368 may determine, for example, pH using the redox-active and pH-sensitive species (anthraquinone), and use a redox-active, pH-insensitive component as the reference compound (e.g. t-butylferrocene sulfonate). The pH is measured using a difference in potential between two redox-active moieties.

The temperature probe 370 may be, for example, a simple thermocouple accurate to within about 1 degrees C. A response of the electrochemical sensor 330 may rely on a number of parameters, which suggests a combination of several in-situ measurements may be undertaken in order to provide desired operational and interpretable capabilities.

Such measurements may include, for example, flowline pressure, temperature, mediator solution pH, mediator concentration, and/or electrode sensing area as provided by the combination of sensing means of the electrochemical sensor 330.

The electrochemical sensor 330 may be provided with additional sensors, such as downhole sensor S as shown in FIG. 3.2. The downhole sensor S is shown in the electrochemical cell 356, but could also be provided in the downhole tool (see, e.g., 210 of FIG. 2.1). For example, external pressure can be measured by pressure sensors PS within the flowline 232 (FIG. 2.1).

The electrochemical sensor 330 may also be provided with a mediator sensor M for measuring concentration of the mediator within the electrochemical cell 356. The mediator sensor may also be used to monitor various parameters measured by the various sensing means, and to allow the electrochemical sensor 330 to calibrate itself. Calibration may be used, for example, to address changes in the downhole conditions and/or changes that occur to the electrochemical sensor 330 during measurement.

FIGS. 4-9 depict various outputs that may be generated by the electrochemical sensor 330 (FIGS. 3.1-3.2). FIG. 4 is a graph 400 depicting cyclic voltammetric data measured using the electrochemical sensor 330. The graph depicts current i (y-axis) versus potential P (x-axis) for a downhole fluid having a pH of 7 and at 34 degrees C., with increasing amounts of an analyte (NA2S) solution added thereto as indicated by the arrow. The outputs were obtained using a ferrocene mediator at increasing concentrations of H2S.

As shown by graph 400, as the amount of analyte increases, the current increases. This current response may depend on a number of factors. For example, the following Randels-Sevich equation below describes the effect of scan rate on the peak current (ip):

$$i_p = 0.4463nFAC\left(\frac{nFvD}{RT}\right)^{1/2} \quad \text{Eqn. (1)}$$

where ip is the maximum current, n is the number of electrons transferred in the redox event (e.g., 1), A is the electrode area, F is the Faraday constant, D is the diffusion coefficient of ferrocene, C is concentration of ferrocene, and v is scan rate. The Randels-Sevich equation (Eqn. (1)) shows that a baseline current may be proportional to the concentration of ferrocene in the downhole fluid, the temperature of the downhole fluid, and the diffusion coefficient of the species.

Figure 5:
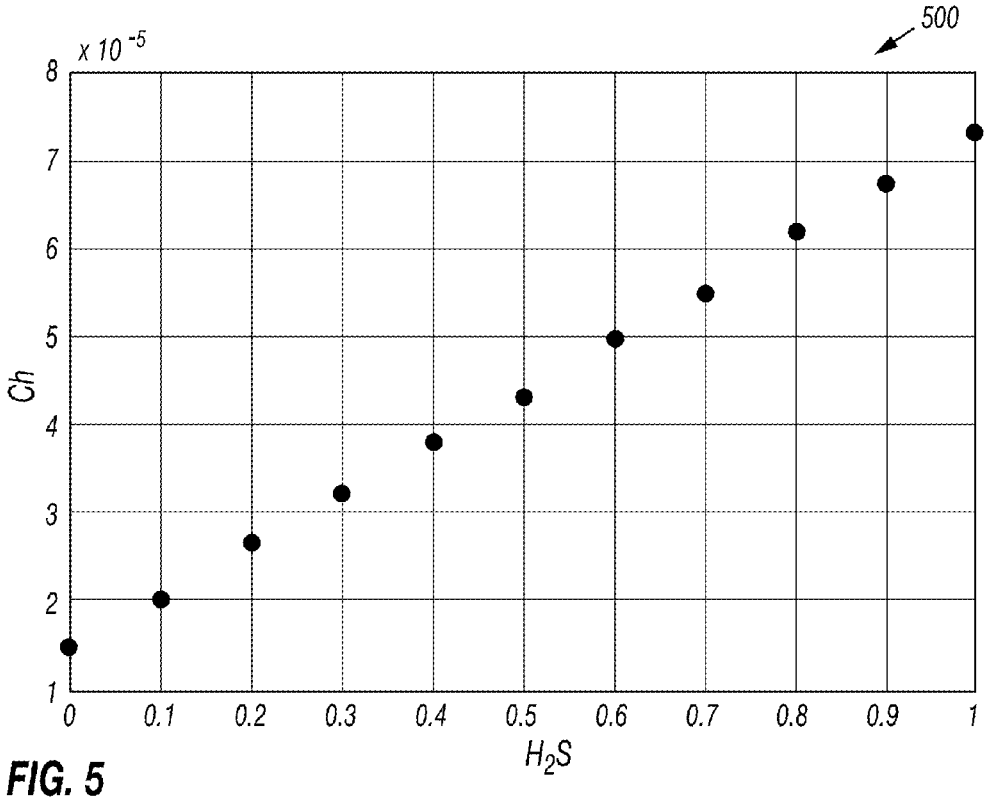
FIG. 5 is a graph illustrating an output of electromechanical sensor at increasing H2S in accordance with embodiments of the present disclosure.

FIG. 5 shows a graph 500 showing charge Ch (+/−200 mV around peak) (y-axis) versus concentration of H2S (x-axis). This graph converts the measurements of cyclic voltammetry of FIG. 4 into a plot of the integrated charge i within a region of the oxidation peak versus concentration of NA2S. As demonstrated by this graph, a catalytic increase in current i (and charge) may, therefore, be proportional to the concentration of H2S.

The analytical response may depend on the parameters as shown in FIG. 5, and on the pH of the sensing solution and the concentration of the mediator. Fluctuations in the pH of the sensing solution may affect the interpretation for the concentration of sulfide being detected outside the electrochemical cell. Such fluctuation in the sensing solution may arise from a sudden influx of high concentration CO2, thereby lowering the pH value of the sensing solution.

FIGS. 6.1-6.3 are graphs 600.1-600.3 depicting example concentrations of chemicals (e.g., H2S and CO2) as measured under various conditions. FIG. 6.1 shows concentration of H2S (y-axis) versus reservoir temperature (x-axis). FIG. 6.2 shows concentration of CO2 (y-axis) versus reservoir temperature (x-axis). FIG. 6.3 shows concentration of CO2 (y-axis) versus concentration of H2S (x-axis). As demonstrated by FIGS. 6.1-6.3, concentration of H2S and CO2 may be plotted (e.g., graphs 600.1, 600.2) as a function of temperature, along with a cross-plot (e.g., 600.3) between the H2S and CO2 concentration.

As also demonstrated by FIGS. 6.1-6.3, the concentration of H2S may be proportional to the concentration of CO2, and, therefore, influxes of CO2 into the electrochemical cell 356 may not be disregarded. To address potential effects of CO2 on the H2S measurement, pH of the cell chamber may also be measured in case the presence of $CO_2$ affects the measurement. Concentrations may be measured at surface using, for example, detector tubes (e.g., Dragor colorimetric gas detector tubes) and considered along with the separator temperature, separator pressure, a recombined composition of the reservoir fluid, the water cut, the reservoir temperature and pressure, and/or a simulator (e.g., a pressure, volume, temperature simulator, such as a PVTsim™) to estimate the concentration of analyte (e.g., H2S) in the downhole fluid.

Referring to FIG. 7, FIG. 7 is a graph 700 depicting square wave voltammetry of a response of the pH sensor 368 (FIG. 3.2) to increasing CO2 of a downhole fluid. The graph 700 depicts current i (y-axis) versus potential P(V) (x-axis) for downhole fluid having various amounts of CO2. As demonstrated by this graph 700, as CO2 exposed to the chemical cell 356 (FIG. 3.2) is increased as indicated by the arrows, both the ferrocine (Fc) and anthraquinone (Aq) waves shift in potential. This shift may be due to an unstable nature of the reference electrode 363 (FIG. 3.2). A more detailed analysis of peak to peak separation 771 of the curves reveals that the ferrocene (Fc) and anthroquinone (Aq) peaks become closer together with an increase in CO2 concentration, thereby indicating a change in pH.

FIGS. 8.1 and 8.2 depict graphs 800.1, 800.2 showing changes in pH of a fluid in a phosphate/bicarbonate buffer. FIG. 8.1 is a graph 800.1 of a change in voltage difference (ΔE) (y-axis) versus time t (x-axis) for a downhole fluid at 100° C. with $CO_2$ pressures of 7.5 Bar, 10 Bar, 15 Bar and 19.8 Bar. FIG. 8.2 is a graph 800.2 of a change in voltage difference (ΔE) (y-axis) versus time t (x-axis) for a downhole fluid at 125° C. with $CO_2$ pressures of 15 Bar, 17.5 Bar and 19.8 Bar. These graphs show that the downhole fluid takes about 5 hours of time t to heat up to downhole temperatures. Once the downhole temperature is reached, the ΔE value stabilizes at each CO2 pressure. Using the calibration detailed above, the lowest pH (e.g., at 19.8 Bar $CO_2$ and 125° C.) is around 6.25 pH units.

As indicated by FIGS. 8.1 and 8.2, in some cases, a delay may be needed before measurements may be taken. For example, during at least some measurements, such as H2S measurement, pH measurement, mediator, concentration, and cyclic voltammetric measurements, sulfide may be consumed within a diffusion layer of the sensing electrode. Time may be needed to allow local replenishment before the next measurement is taken. For example, in non-stirred conditions, at a 3 mm electrode at 75 degrees C., replenishment may take about 7 to 8 minutes. The mediator concentration measurement may be performed at the same electrode as the H2S measurement and can be done within these 7-8 minutes. An example measurement cycle may involve taking a measurements, such as H2S and pH measurements, with a waiting period (e.g., from about 5 to about 8 mins) between measurements.

FIG. 9 shows a graph 900 depicting pH (y-axis) versus pressure of CO2 (x-axis) at 100 degrees C. As shown by FIG. 9, measured pH is shown at differing pressures of CO2, along with the error bars from repeating the measurements. Graph 900 shows that measurement errors are within a range of about ±0.20 pH units. As demonstrated by FIG. 9, a combination of sensors (e.g., analyte sensor 366, pH sensor 368, and mediator sensor M) may be used to measure a variety of downhole parameters and permit an evaluation based on multiple measurements. The combination of sensors may also be used to perform calibrations to address potential error in the measurements.

Error may occur due to a variety of reasons. For example, changes in pH may occur during measurement, and/or a concentration of the mediator may change (and so alter a calibration curve) for several reasons. In another example, water might transfer across the membrane due to salinity differences between the fluid within the measurement cell and brines within the flowline (osmosis), causing the effective mediator concentration to change.

In some cases, the sensor 330 may be exposed to concentrated brines (or as in the testing with gas mixtures, gas with low humidity). For example, ferrocene may transport across the membrane 358. This transport may happen if the dense selective layer of the membrane 358 becomes plasticized by prolonged exposure to high concentration CO2 or crude oil, or because of seal failure. In another example, the ferrocene may thermally degrade within the cell at high temperatures, leading to a decrease in its concentration.

Calibration may be used to address at least some of the items that may affect measurement. The graph 900 shows how a pH sensor can be used within an $H_2S$ sensor to calibrate for any pH drifts. In addition to the pH measurement, the concentration of mediator may be monitored. This may be conducted using square wave voltammetry to monitor the mediator concentration in the presence and the absence of the analyte.

Figure 10:
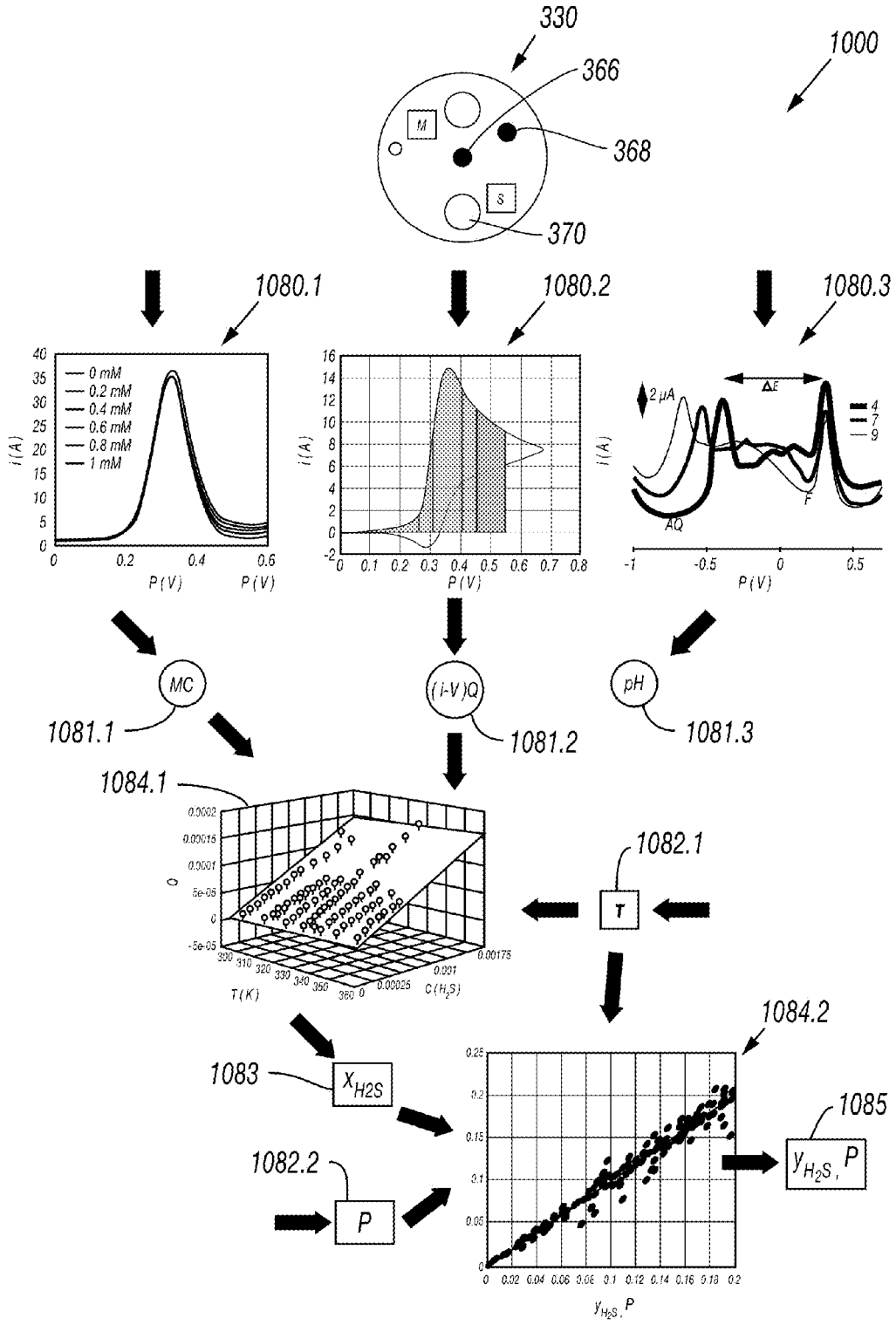
FIG. 10 is a schematic diagram illustrating a measurement chain for determining parameters of a downhole fluid in accordance with embodiments of the present disclosure.

FIG. 10 is a schematic diagram depicting a measurement chain 1000 for determining parameters of chemicals in downhole fluids. The measurement chain 1000 demonstrates a process for using measurements 1080.1-1080.3 generated by the electrochemical sensor 330 to determine downhole parameters. Various measurements from the electrochemical sensor 330 may include influences of a variety of parameters that may impact the downhole parameters.

As shown, the measurement chain 1000 includes three different types of electrochemical measurements 1080.1-1080.3. Measurement 1080.1 is a graph of square wave voltammetry measured by analyte sensor 366. The measured square wave voltammetry may be used to infer an output 1081.1, such as a mediator concentration MC. Measurement 1080.2 may be a graph of cyclic voltammetry measured by the analyte sensor 366 to provide output 1081.2, such as a current-voltage relationship i-V(Q). The measurement 1080.3 may be a square wave voltammetry measured by a pH sensor 368. This measurement 1080.3 may be used to infer an output 1081.3, such as pH.

Additional inputs may be combined with the outputs 1080.1-1080.3 for analysis. For example, other parameters, such as a temperature input 1082.1 measured by temperature sensor 370 and/or a pressure input 1082.2 measured by a pressure sensor PS in the flowline (FIG. 2.1), may be measured and/or provided. The various measurements may be taken by the electrochemical sensor 330 as part of the process, or provided separately from historical data, client data, libraries, or other sources.

A calibration model 1084.1 may be used to combine the various outputs 1081.1-1081.3 generated from the measurements 1080.1-1080.3 with the input 1082.1. The calibration model may be a conventional calibration model capable of combining the outputs. From this combination, a secondary output 1083, such as concentration xH2S of H2S within the electrochemical cell 356, may be inferred. From this secondary output 1083, the temperature input 1082.1 and pressure input 1082.2 may also be combined using a gas solubility model 1084.2. The gas solubility model may be a conventional model capable of combining the outputs. A third output 1085, such as the equivalent partial pressure of $H_2S$ within the flowline $y_{H2S}$·P, may then be inferred based on the gas solubility model 1084.2.

Optionally, additional data may be incorporated into various portions of the measurement chain to further refine the various outputs. For example, historical data concerning the fluid, wellsite, downhole tool, or other information, may be input to enhance the models 1084.1, 1084.2. The additional information may also be used, for example, to enhance the outputs 1081.1-1081.3 generated from the measurements 1080.1-1080.3. Other downhole parameters may be provided by the measurements and/or outputs. Other models and/or combinations of data may be used to obtain other information about downhole operations. Cross-checks and calibrations may optionally be performed for quality assurance and quality control.

FIGS. 11.1 and 11.2 are flow charts depicting methods 1100.1 of determining parameters of a downhole fluid. The method 1100.1 involves 1190—deploying a downhole tool with an electrochemical sensor into the wellbore. The electrochemical sensor includes a bulkhead carried by the downhole tool, a membrane exposed to the downhole fluid in the flowline, and an electrochemical cell supported by the bulkhead adjacent the membrane. The electrochemical cell includes a plurality of cell sensors, at least one cell electrode, and a sensing solution. The cell sensors include an analyte sensor, a temperature sensor, and a pH sensor. The method also involves 1192—exposing the membrane to the downhole fluid in the flowline, and 1194—measuring parameters of the downhole fluid by measuring electrical signals generated by reaction of the sensing solution with certain analytes in the downhole fluid with the plurality of cell sensors.

The method 1100.2 involves 1195—obtaining square wave and cyclic voltammetries measurements of an electrochemical sensor exposed to a downhole fluid, 1196—generating electrode parameters of an electrochemical sensor based on the square wave and cyclic voltammetries (the electrode parameters comprising mediator concentration, current-volt relations, and pH), 1197—obtaining temperature and pressure measurements of the downhole fluid, 1198—determining a concentration of an analyte of the downhole fluid by combining the generated electrode parameters with the temperature measurement using a calibration model, 1199—generating pressure of the analyte by combining the concentration of the analyte with the measured pressure using a gas solubility model. Various combinations of the methods 1100.1, 1100.2 may be performed in any order.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. An electrochemical sensor of a downhole tool positionable in a wellbore penetrating a subterranean formation, the downhole tool having a flowline to receive downhole fluid, the electrochemical sensor comprising:

a bulkhead carried by the downhole tool;

a membrane exposed to the downhole fluid in the flowline; and an electrochemical cell supported by the bulkhead adjacent the membrane, the electrochemical cell comprising a plurality of cell sensors, at least one cell electrode, a sensing solution, and a mediator sensor, the plurality of cell sensors comprising an analyte sensor, a temperature sensor, and a pH sensor, the sensing solution reactive to certain analytes in the downhole fluid to generate electrical signals measurable by the plurality of cell sensors whereby parameters of chemicals in the downhole fluid may be measured, wherein the analyte sensor measures square wave and cyclic voltammetry, wherein the temperature sensor measures temperature using a calibration model, wherein the pH sensor measures square wave voltammetry, and wherein the mediator sensor determines a mediator concentration of the sensing solution from the square wave, the current-voltage relationship, and the pH, and whereby the mediator concentration, the current-voltage relationship, and the pH combine with the temperature to determine a concentration of the analyte of the downhole fluid in the flowline, and whereby the concentrate of the analyte combines with the measured pressure to measure pressure of the downhole fluid in the flowline and to determining a partial pressure of the analyte within the flowline, using a gas solubility model.

2. The electrochemical sensor of claim 1, wherein the analyte sensor comprises at least one of an H2S, CH4, CO2, Hg, O2, and an H2 sensor.

3. The electrochemical sensor of claim 1, wherein H2S is detectable with the analyte sensor via mediated oxidation in an electrocatalytic pathway.

4. The electrochemical sensor of claim 1, wherein the plurality of cell sensors generates an analytical signal dependent on parameters measured by at least one of the plurality of sensors.

5. The electrochemical sensor of claim 1, wherein the at least one cell electrode comprises at least one of a counter electrode and a reference electrode.

6. The electrochemical sensor of claim 5, wherein the plurality of cell sensors is coupled with at least one of the counter electrode and the reference electrode.

7. The electrochemical sensor of claim 6, wherein the at least the sensing electrode is at least as large as the counter electrode.

8. The electrochemical sensor of claim 1, wherein the sensing solution comprises an electrocatalytic mediator comprising at least one of ferrocene, ferrocyanide, and combinations thereof.

9. The electrochemical sensor of claim 1, wherein the plurality of cell sensors comprises an H2S sensor, a pH sensor, and a CO2 sensor.

10. A method of determining downhole parameters of a downhole fluid about a wellbore penetrating a subterranean formation, the method comprising:

deploying a downhole tool into the wellbore, the downhole tool having a flowline therein to receive downhole fluid and an electrochemical sensor, the electrochemical sensor comprising a bulkhead carried by the downhole tool, a membrane exposed to the downhole fluid in the flowline, and an electrochemical cell supported by the bulkhead adjacent the membrane, the electrochemical cell comprising a plurality of cell sensors, at least one cell electrode, and a sensing solution, the plurality of cell sensors comprising an analyte sensor, a temperature sensor, and a pH sensor;

exposing the membrane to the downhole fluid in the flowline;

measuring parameters of the downhole fluid by measuring electrical signals generated by reaction of the sensing solution with certain analytes in the downhole fluid with the plurality of cell sensors, wherein the measuring parameters comprises measuring square wave voltammetry with the analyte sensor, cyclic voltammetry with the analyte sensor, and square wave voltammetry with the pH sensor;

comprising determining a mediator concentration from the square wave voltammetry, the current-voltage relationship, and the pH;

determining a concentration of the analyte of the downhole fluid in the flowline by combining the mediator concentration, the current-voltage relationship, and the pH with temperature measured by the temperature sensor using a calibration model;

comprising measuring pressure of the downhole fluid in the flowline and determining a partial pressure of the analyte within the flowline by combining the concentrate of the analyte with the measured pressure using a gas solubility model.

11. The method of claim 10, wherein the measuring comprises determining the pH utilizing at least one of redox-active and pH-sensitive species, a redox-active, pH-sensitive and a redox-active, pH-insensitive component, and a difference in potential of the two redox-active moieties.

12. The method of claim 10, further comprising calibrating a drift of a reference electrode with the pH sensor.

13. A method of determining downhole parameters of a downhole fluid about a wellbore penetrating a subterranean formation, the method comprising:

deploying an electrochemical sensor into the wellbore;

obtaining square wave and cyclic voltammetries measurements of the electrochemical sensor exposed to the downhole fluid;

generating electrode parameters of the electrochemical sensor based on the square wave and cyclic voltammetries, the electrode parameters comprising mediator concentration, current-volt relations, and pH;

obtaining temperature and pressure measurements of the downhole fluid;

generating a concentration of an analyte of the downhole fluid by combining the generated electrode parameters with the temperature measurement using a calibration model; and generating pressure of the analyte by combining the concentration of the analyte with the pressure measurement using a gas solubility model.

14. The method of claim 13, wherein the obtaining comprises measuring the downhole fluid with the electrochemical sensor, the electrochemical cell comprising a plurality of cell sensors, at least one cell electrode, and a sensing solution, the plurality of cell sensors comprising an analyte sensor, a temperature sensor, and a pH sensor.

* * * * *